US008678789B2

(12) United States Patent
Orum et al.

(10) Patent No.: US 8,678,789 B2
(45) Date of Patent: Mar. 25, 2014

(54) REFRIGERATION COMPRESSOR WITH FLEXIBLE DISCHARGE CONDUIT

(75) Inventors: Timothy James Hamlet Orum, Auckland (NZ); Adrian Chaplin Jaan Hills, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 1562 days.

(21) Appl. No.: 11/996,004

(22) PCT Filed: Jul. 24, 2006

(86) PCT No.: PCT/NZ2006/000185
§ 371 (c)(1),
(2), (4) Date: Mar. 31, 2008

(87) PCT Pub. No.: WO2007/011247
PCT Pub. Date: Jan. 25, 2007

(65) Prior Publication Data

US 2008/0245094 A1 Oct. 9, 2008

(30) Foreign Application Priority Data

Jul. 22, 2005 (NZ) ..... 541437

(51) Int. Cl.
*F04B 35/04* (2006.01)
*F04B 17/00* (2006.01)
*F28F 21/00* (2006.01)

(52) U.S. Cl.
USPC ..... 417/423.14; 417/415; 165/180

(58) Field of Classification Search
USPC ..... 417/415, 416, 417, 44.1, 902; 62/426
See application file for complete search history.

(56) References Cited

U.S. PATENT DOCUMENTS

| | | | | | |
|---|---|---|---|---|---|
| 2,213,325 | A | * | 9/1940 | Nystrom | 417/415 |
| 2,500,751 | A | * | 3/1950 | Halfvarson | 417/363 |
| 2,741,498 | A | * | 4/1956 | Elliott | 285/148.11 |
| 2,797,857 | A | * | 7/1957 | Warner | 417/372 |
| 3,021,995 | A | * | 2/1962 | Neubauer | 417/419 |
| 3,187,996 | A | * | 6/1965 | Knud | 417/312 |
| 3,279,683 | A | * | 10/1966 | Kleinlein | 417/363 |
| 3,687,019 | A | * | 8/1972 | Wolf | 92/169.1 |
| 3,785,025 | A | * | 1/1974 | Wolf | 29/888.02 |
| 4,371,199 | A | * | 2/1983 | Kushner et al. | 285/382.2 |
| 4,515,305 | A | * | 5/1985 | Hagemeister | 228/173.2 |

(Continued)

FOREIGN PATENT DOCUMENTS

| | | |
|---|---|---|
| WO | 00/14410 | 3/2000 |
| WO | 02/25111 | 3/2002 |
| WO | 2004/106737 | 12/2004 |

OTHER PUBLICATIONS

International Search Report Dated Dec. 13, 2006; Two (2) Pages.

(Continued)

*Primary Examiner* — Charles Freay
*Assistant Examiner* — Alexander Comley
(74) *Attorney, Agent, or Firm* — Clark Hill PLC

(57) ABSTRACT

A refrigeration compressor includes a housing having a suction gases inlet and a compressed gases outlet. A linear compressor is supported for operation within the housing. A compressed gases discharge conduit extends from the linear compressor to the housing to connect with the outlet. The conduit is formed of a material of lower heat conductivity than the housing. The conduit passes through the wall of the housing at the compressed gases outlet.

22 Claims, 2 Drawing Sheets

(56) References Cited

U.S. PATENT DOCUMENTS

| | | | | |
|---|---|---|---|---|
| 5,101,931 | A * | 4/1992 | Blass et al. | 181/240 |
| 5,993,178 | A * | 11/1999 | Park et al. | 417/545 |
| 6,092,999 | A * | 7/2000 | Lilie et al. | 417/415 |
| 6,267,565 | B1 * | 7/2001 | Seibel et al. | 417/292 |
| 6,514,047 | B2 * | 2/2003 | Burr et al. | 417/53 |
| 6,644,943 | B1 * | 11/2003 | Lilie et al. | 417/418 |
| 6,776,589 | B2 * | 8/2004 | Tomell et al. | 417/415 |
| 6,884,044 | B2 * | 4/2005 | Lilie et al. | 417/363 |
| 2002/0057973 | A1 * | 5/2002 | Choi et al. | 417/415 |
| 2005/0042113 | A1 * | 2/2005 | Lee | 417/312 |
| 2005/0123422 | A1 * | 6/2005 | Lilie | 417/416 |
| 2005/0142008 | A1 * | 6/2005 | Jung et al. | 417/417 |
| 2005/0142009 | A1 * | 6/2005 | Song et al. | 417/417 |
| 2005/0158193 | A1 * | 7/2005 | Roke et al. | 417/417 |
| 2005/0172646 | A1 * | 8/2005 | Kawabata et al. | 62/114 |
| 2005/0214140 | A1 * | 9/2005 | Lee et al. | 417/416 |

OTHER PUBLICATIONS

International Preliminary Report on Patentability Dated Jul. 2, 2007; Three (3) Pages.

Written Opinion of the International Searching Authority Dated Dec. 13, 2006; Three (3) Pages.

Notification of Transmittal of International Preliminary Report on Paentability Dated Jul. 5, 2007; One (1) Page.

* cited by examiner

REFRIGERATION COMPRESSOR WITH FLEXIBLE DISCHARGE CONDUIT

This application is a National Phase filing of PCT/NZ2006/000185, having an International filing date of Jul. 24, 2006, which disclosure is herein incorporated by reference in its entirety.

FIELD OF THE INVENTION

The present invention relates to refrigeration compressors, and in particular to linear compressors of the type suitable for use in a vapour compression refrigeration system.

BACKGROUND TO THE INVENTION

Linear compressors of a type for use in a vapour compression refrigeration system are the subject of many documents in the prior art. One such document is our co-pending PCT patent application PCI/NZ2004/000108. That specification describes a variety of developments relating to such compressors, many of which have particular application to the linear compressors.

The present invention relates to further improvements to compressor embodiments such as are described in that patent application which provides a general exemplification of a compressor to which the present invention may be applied. However the present may also be applied beyond the scope of the particular embodiments of a linear compressor disclosed in that application. Persons skilled in the art will appreciate the general application of the ideas herein to other embodiments of linear compressors such as are found in the prior art.

The present invention relates generally to the conduit for carrying the compressed gases from the head of the compressor to the compressor shell, and to the connections of that conduit to the compressor and shell. In our patent application noted above we described a compressor embodiment with a flexible discharge conduit 28024 with reference to FIG. 28 therein. The present invention relates to improvements to connections of flexible polymer discharge conduits to the compressor shell.

SUMMARY OF THE INVENTION

It is an object of the present invention to provide a refrigeration compressor including an improved connection between a flexible discharge conduit and a hermetic housing, with particular application to linear compressors.

In a first aspect the invention consists in a refrigeration compressor comprising:

a housing having a suction gases inlet and a compressed gases outlet, a linear compressor supported for operation within said housing, and a compressed gases discharge conduit extending from said linear compressor to said housing to connect with said outlet, said conduit being formed of a material of lower heat conductivity than said housing, said conduit passing through the wall of said housing at said compressed gases outlet.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

DETAILED DESCRIPTION

Figure 1:
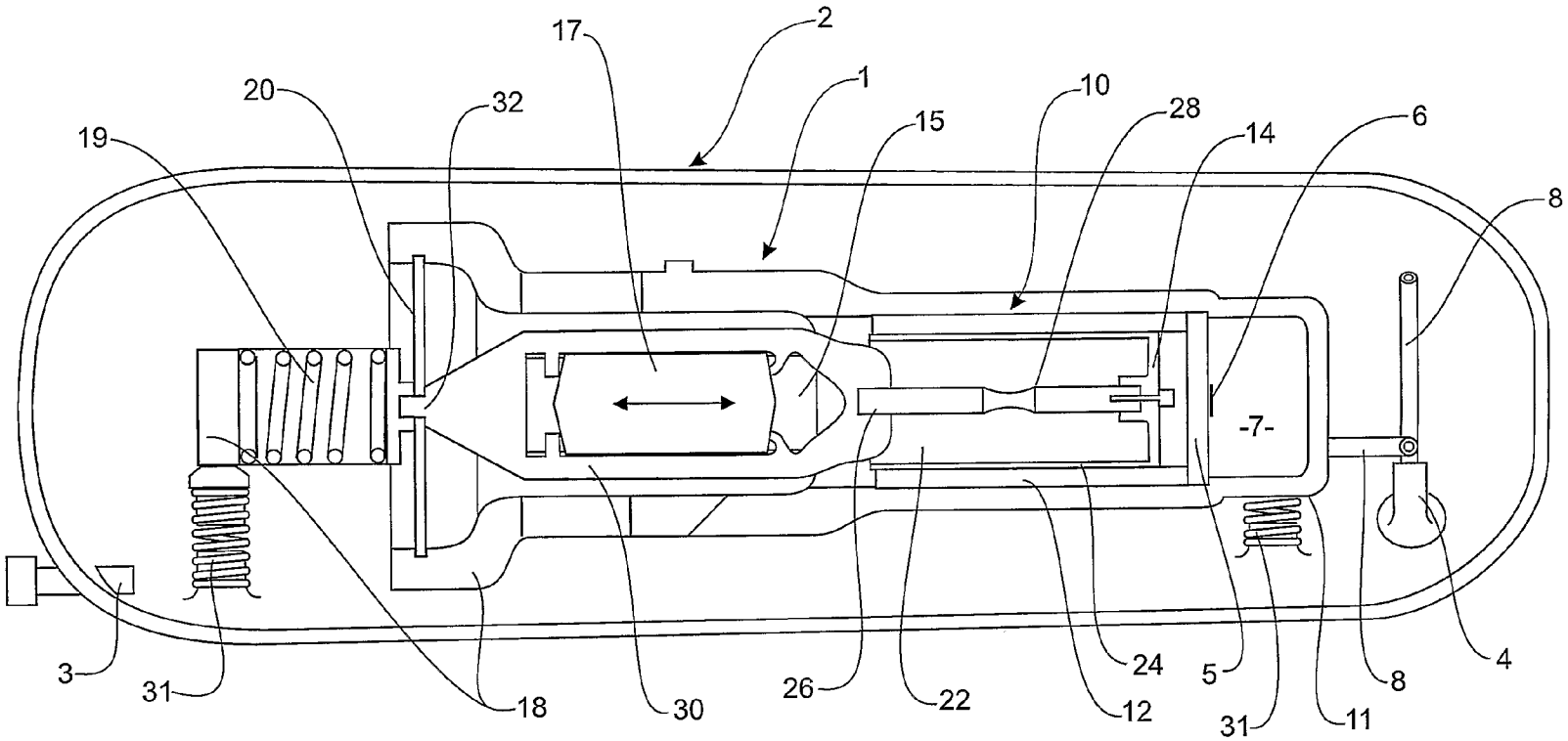
FIG. 1 is a side elevation in cross-section of a refrigeration compressor including a linear compressor suspended in a housing.

Referring to FIG. 1 the compressor for a vapour compression refrigeration system includes a linear compressor 1 supported inside a housing 2. Typically the housing 2 is hermetically sealed and includes a gases inlet port 3 and a compressed gases outlet port 4. Uncompressed gases flow within the interior of the housing, surrounding the compressor 1. These uncompressed gases are drawn into the compressor during intake stroke, compressed between the piston crown 14 and outlet valve plate 5 on the compression stroke and expelled through discharge valve 6 into a compressed gases manifold 7. Compressed gases exit the manifold 7 to the outlet port 4 in the shell through a flexible tube 8. To reduce the stiffness effect of discharge tube 8 the tube is preferably arranged as a loop or spiral transverse to the reciprocating axis of the compressor.

The intake to the compression space may be through the piston (with an aperture and valve in the crown) or through the head, divided to include suction and discharge manifolds and valves.

The illustrated linear compressor 1 has, broadly speaking, a cylinder part and a piston part connected by a main spring. The cylinder part includes cylinder chassis 10, cylinder head 11, valve plate 5 and a cylinder liner 12. The cylinder part also includes stator parts 15 for a linear electric motor. An end portion 18 of the cylinder part, distal from the head 11, mounts the main spring relative to the cylinder part. In the illustrated embodiment the main spring is formed as a combination of coil spring 19 and flat spring 20.

The piston part includes a hollow piston 22 with sidewall 24 and crown 14. A rod 26 connects between the crown 14 and a supporting body 30 for linear motor armature 17. The rod has a flexible portion 28 in approximately the centre of the hollow piston 22. The linear motor armature 17 comprises a body of permanent magnet material (such as ferrite or neodymium) magnetised to provide one or more poles directed transverse to the axis of reciprocation of the piston within the cylinder liner. An end portion 32 of armature support 30 which is distal from the piston 22 is connected with the main spring 19, 20.

The linear compressor 1 is mounted within the shell 2 on a plurality of suspension springs to isolate it from the shell. In use the large outer body of the linear compressor, the cylinder part, will oscillate along the axis of reciprocation of the piston part within the cylinder part. In the preferred compressor the piston part is purposely kept very light compared to the cylinder part so that the oscillation of the cylinder part is small compared with the relative reciprocation between the piston part and cylinder part. In the illustrated form the linear compressor is mounted on a set of four suspension springs 31 generally positioned around the periphery. Alternate suspension spring arrangements are illustrated in PCT/NZ2004/000108. The ends of each suspension spring fit over elastomeric snubbers connected with the linear compressor 1 at one end of each spring and connected with the compressor shell 2 at the other end of each spring.

This briefly describes a linear compressor of a type for which the improved discharge conduit connection of the present invention is useful. However it will be appreciated that the usefulness of the present invention is not restricted to linear compressors of the type and configuration illustrated. The improvement is generally applicable.

Figure 2:
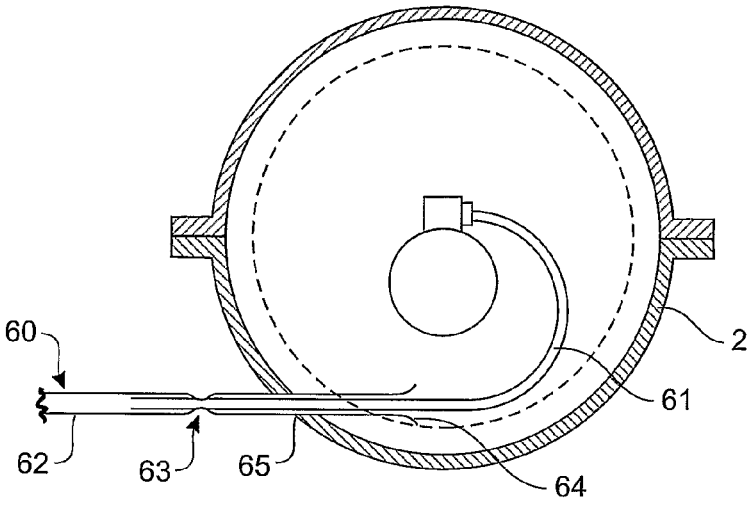
FIG. 2 is a cross-sectional side elevation of the relevant portion of the housing illustrating the connection of flexible discharge conduit at the outlet according to the preferred embodiment of the present invention.

Illustrated in FIG. 2 is a cross-sectional side elevation of a portion of the housing 2. This portion includes an outlet 60 through which the compressed gases exit the refrigeration compressor. An outlet is located outside the compressor housing for connection to refrigeration conduit typically leading to a condenser. The outlet 60 is connected to the compressor assembly via a flexible discharge tube 61 through which compressed gases may flow.

The discharge tube 61 connects to the discharge of the compressor inside the housing and extends through the wall of the housing to discharge compressed gases to the outlet tube 62 at a location outside the housing. The discharge tube is made from a material that has lower heat conductivity than the housing material. For example the tubing may be a polymer/plastic, for example PTFE, while the housing may be pressed steel. This combination of insulative material and extending through the housing is advantageous as the discharge tube insulates the housing from being unnecessarily heated by the flow of hot gases produced by the compressor.

The portion of the discharge tube 61 extending through the wall of the housing 2 is preferably enclosed in the outlet tube 62. The outlet tube is preferably a type of metal tubing such as the copper tubing commonly found in refrigeration systems. The inner diameter of the outlet tube is comparable to the outside diameter of the discharge tube. A seal is formed between the overlapping section of the outlet tube and discharge tube by crimping or swaging of the outlet tube for example at point 63 outside the housing. The inside surface of the outlet tube deforms against the outside surface of the discharge tube, engaging the sections. The discharge tube extends through the housing, therefore the crimp or swage may occur outside the compressor housing allowing the appropriate tooling to easily access the necessary area and allowing the seal to be made after the compressor is fitted into the housing.

A suitable sealant may also be included between the exterior of the discharge tube and the interior of the outlet tube.

The outlet tube 62 may also extend inside the compressor housing. The leading edge 64 of the outlet tube within the housing is preferably flared to allow the discharge conduit to easily be inserted inside the second hollow body when assembling the compressor into the housing. The flare 64 also reduces fretting or wear of the discharge tube 61 at the entrance of the outlet tube.

The outside surface of the outlet tube 62 is welded or brazed into an aperture 65 of the compressor housing 2 before assembly. The discharge tube may be connected to the compressor, then the compressor introduced to the housing, and the discharge tube inserted through the outlet tube and secured by swaging the outside housing.

Figure 3:
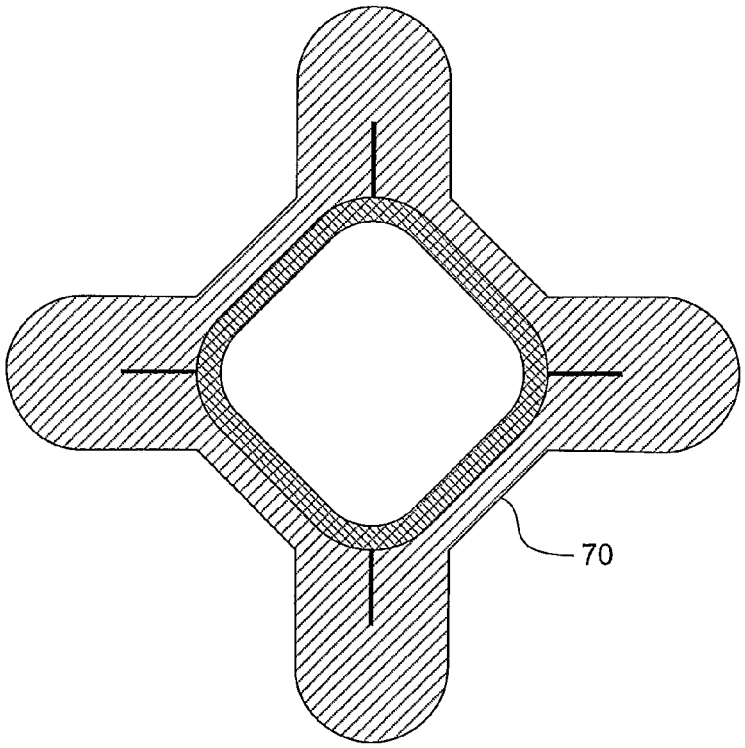
FIG. 3 is a cross section taken on line A-A in FIG. 2.

To stop the enclosed section of the discharge tube rotating relative to the outlet tube which may eventually cause undue wear, the outlet tube may be crimped inside the housing. The crimp forces a noncircular profile 70 into the sides of the tubes that locks their rotational position. FIG. 3 shows a cross-sectional view of the crimped tubes. This crimp need not be sufficiently accurate to produce a seal if the swage outside the housing is also made.

As well as promoting a seal against the outside of the discharge tube the crimps or swages also mechanically secures the discharge tube inside the outlet tube, against a tendency to blow out under pressure.

The above embodiment provides a refrigeration compressor comprising a housing having a suction gases inlet and a compressed gases outlet, a linear compressor supported for operation within the housing, and a compressed gases discharge conduit extending from the linear compressor to the housing to connect with the outlet. The conduit is formed of a material of lower heat conductivity than the housing, and passes through the wall of the housing at the compressed gases outlet.

Preferably the conduit passes into a hollow tubular body extending from the outer surface of the housing, and forms a seal therewith.

Preferably the hollow tubular body is crimped or swaged at a location outside the housing such that the inside surface thereof seals against the outside surface of the discharge conduit.

Preferably the hollow tubular body extends through the wall of the housing and protrudes from the inside surface of the wall. The inner edge of the protruding end diverges from the outer surface of the discharge conduit.

Preferably the protruding end of the hollow tubular body locks the portion of the discharge conduit passing through it from relative rotation. For example the protruding end may be suitably swaged or deformed.

The flexible discharge conduit may be a suitable polymer/plastic material, for example a PTFE based plastic material. The hollow tubular body may be a copper (or other metal) pipe, and may be brazed (for example) to the housing.

The invention claimed is:

1. A refrigeration compressor comprising: a housing having a wall with an outer surface, a suction gases inlet and a compressed gases outlet, a hollow tubular body extending from said outer surface of said housing, a linear compressor supported for operation within said housing, and a compressed refrigerant discharge conduit extending from said linear compressor to said housing to connect with said compressed gases outlet, said discharge conduit passing into said hollow tubular body, said discharge conduit and said hollow tubular body having a point of direct contact with each other to form a seal therebetween at the point of direct contact, said discharge conduit being formed of a material of lower heat conductivity than said housing, said discharge conduit passing through the wall of said housing at said compressed gases outlet.

2. A refrigeration compressor as claimed in claim 1 wherein an inside surface of said hollow tubular body is crimped or swaged outside said housing against an outside surface of said discharge conduit to form said seal.

3. A refrigeration compressor as claimed in claim 1 wherein said hollow tubular body extends through the wall of said housing and protrudes from an inside surface of said wall such that a protruding end of said hollow tubular body is defined, said protruding end having an inner edge, the inner edge of said protruding end diverging from an outside surface of said discharge conduit.

4. A refrigeration compressor as claimed in claim 3 wherein said hollow tubular body and said discharge conduit are locked together inside said housing to prevent relative rotation between said discharge conduit and said hollow tubular body.

5. A refrigeration compressor as claimed in claim 2 wherein said hollow tubular body extends through the wall of said housing and protrudes from an inside surface of said wall such that a protruding end of said hollow tubular body is defined, said protruding end having an inner edge, the inner edge of said protruding end diverging from the outer surface of said discharge conduit.

6. A refrigeration compressor as claimed in claim 5 wherein said hollow tubular body and said discharge conduit are locked together inside said housing to prevent relative rotation between said discharge conduit and said hollow tubular body.

7. A refrigeration compressor as claimed in claim 1 wherein the discharge conduit is constructed from one of a polymer and plastic material.

8. A refrigeration compressor as claimed in claim 2 wherein the discharge conduit is constructed from one of a polymer and plastic material.

9. A refrigeration compressor as claimed in claim 3 wherein the discharge conduit is constructed from one of a polymer and plastic material.

10. A refrigeration compressor as claimed in claim 5 wherein the discharge conduit is constructed from one of a polymer and plastic material.

11. A refrigeration compressor as claimed in claim 1 wherein the hollow tubular body is a metal pipe brazed to the housing.

12. A refrigeration compressor as claimed in claim 2 wherein the hollow tubular body is a metal pipe brazed to the housing.

13. A refrigeration compressor as claimed in claim 3 wherein the hollow tubular body is a metal pipe brazed to the housing.

14. A refrigeration compressor as claimed in claim 4 wherein the hollow tubular body is a metal pipe brazed to the housing.

15. A refrigeration compressor as claimed in claim 5 wherein the hollow tubular body is a metal pipe brazed to the housing.

16. A refrigeration compressor as claimed in claim 6 wherein the hollow tubular body is a metal pipe brazed to the housing.

17. A refrigeration compressor as claimed in claim 9 wherein the hollow tubular body is a metal pipe brazed to the housing.

18. A refrigeration compressor comprising: a housing having an outer surface, a suction gases inlet and a compressed gases outlet, a hollow tubular body extending from the outer surface of said housing, said hollow tubular body having an inside surface, a linear compressor supported for operation within said housing, a compressed refrigerant discharge conduit extending from said linear compressor to said housing to connect with said compressed gases outlet, said discharge conduit being formed of a material of lower heat conductivity than said housing, said discharge conduit passing through a wall of said housing at said compressed gases outlet, said discharge conduit having an outside surface, wherein said discharge conduit passes into said hollow tubular body and wherein said hollow tubular body is crimped or swaged outside said housing such that the outside surface of the discharge conduit has a point of direct contact with the inside surface of the hollow tubular body and the inside surface thereof seals directly against the outside surface of said discharge conduit at the point of direct contact to form a seal.

19. A refrigeration compressor as claimed in claim 18 wherein said hollow tubular body extends through the wall of said housing and protrudes from the inside surface of said wall such that a protruding end of said hollow tubular body is defined, said protruding end of said hollow tubular body and said discharge conduit are locked together inside said housing to prevent relative rotation between said discharge conduit and said hollow tubular body.

20. A refrigeration compressor as claimed in claim 18 wherein said hollow tubular body extends through the wall of said housing and protrudes from the inside surface of said wall such that a protruding end of said hollow tubular body is defined, said protruding end having an inner edge, the inner edge of said protruding end diverging from the outside surface of said discharge conduit.

21. A refrigeration compressor as claimed in claim 18 wherein the discharge conduit is constructed from one of a polymer and plastic material.

22. A refrigeration compressor comprising: a housing having a suction gases inlet and a compressed gases outlet, a hollow tubular body extending outward from said housing at the compressed gases outlet, a linear compressor supported for operation within said housing, and a compressed refrigerant discharge conduit extending from said linear compressor to said hollow tubular body, said discharge conduit passing into said hollow tubular body through said housing and having a point of direct contact with an inside surface of said hollow tubular body outside said housing to form a seal therebetween at the point of direct contact, wherein the seal at the point of direct contact is the only seal between the hollow tubular body and the discharge conduit.

* * * * *